US009933152B1

(12) United States Patent
Cannon

(10) Patent No.: US 9,933,152 B1
(45) Date of Patent: Apr. 3, 2018

(54) ELECTRICAL PLUG ASSIST TOOL

(71) Applicant: Microsoft Technology Licensing, LLC, Redmond, WA (US)

(72) Inventor: Lawrence Dale Cannon, Bothell, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/277,764

(22) Filed: Sep. 27, 2016

(51) Int. Cl.

| | |
|---|---|
| ***B25B 23/18*** | (2006.01) |
| ***F21V 33/00*** | (2006.01) |
| ***B25B 27/00*** | (2006.01) |
| ***F21V 23/04*** | (2006.01) |
| ***F21L 4/00*** | (2006.01) |

(52) U.S. Cl.
CPC ..... *F21V 33/0084* (2013.01); *B25B 27/00* (2013.01); *F21L 4/00* (2013.01); *F21V 23/0414* (2013.01)

(58) Field of Classification Search
USPC ..... 362/120, 119, 109
See application file for complete search history.

(56) References Cited

U.S. PATENT DOCUMENTS

| | | | | |
|---|---|---|---|---|
| 7,181,999 | B1 | 2/2007 | Skeels et al. | |
| 7,815,356 | B2 | 10/2010 | Lutz et al. | |
| D750,943 | S | 3/2016 | Payne | |
| 2008/0172800 | A1* | 7/2008 | Levy | B25B 27/00 7/107 |
| 2014/0140076 | A1 | 5/2014 | Morrow et al. | |
| 2014/0352500 | A1 | 12/2014 | Huang | |

FOREIGN PATENT DOCUMENTS

TW 201041258 A 11/2010

OTHER PUBLICATIONS

"IDEAL Pro Installer Tools", Retrieved on: Jul. 21, 2016 Available at: http://www.cableorganizer.com/ideal-industries/33-945-pro-installer-kit.html.
"Coax BNC & F connector Removal and Insert Tool", Retrieved on: Jul. 21, 2016 Available at: http://www.gloryal-network.com/products/Coax-BNC-F-connector-Removal-and-Insert-Tool-2055124.html.
"Connectors removal Network Tool", Retrieved on: Jul. 21, 2016 Available at: http://www.gloryal-network.com/products/Connectors-removal-Network-Tool-2055113.html.
"Parts Express F Connector Removal Tool ", Retrieved on: Jul. 21, 2016 Available at: http://www.parts-express.com/parts-express-f-connector-removal-tool--360-089.
"Cool Tools: Crimping Tools", Published on: Jan. 2012 Available at: http://www.ecmag.com/products/cool-tools-crimping-tools.
"GS4H121W", Retrieved on: Jul. 21, 2016 Available at: http://www.panduit.com/en/products-and-services/products/tools/plastic-cable-tie-installation-tools/tool-controlled-tension-and-cutoff/GS4H121W.

* cited by examiner

*Primary Examiner* — Vip Patel
(74) *Attorney, Agent, or Firm* — Baker & Hostetler LLP

(57) ABSTRACT

A tool includes a handle, a shaft coupled to the handle, and a tip coupled to the shaft such that the shaft is between the handle and the tip. The tip includes a tip body that defines a recess configured to receive a plug. The tip body further defines a first opening configured to provide a first passageway for the plug into the recess, and the tip body further defines a second opening configured to provide a second passageway for a cord attached to the plug out of the recess.

20 Claims, 7 Drawing Sheets

ELECTRICAL PLUG ASSIST TOOL

TECHNICAL FIELD

The present application relates generally to tools configured to allow a user of the tool to interact with a confined space. More specifically, the present application is related to tools, configured to receive an electrical plug and engage the plug with an electrical receptacle in a confined space.

BACKGROUND

Servers are often stored in server racks. The server racks may carry multiple servers or other components with different depths. While it may be relatively easy to reach the receptacles at on the rear of a server with a depth nearly equal to the depth of the server rack upon which it is placed, it is more difficult to reach and connect plugs into the receptacles of a server with a depth that is much less than the depth of the server rack upon which it is placed.

Restrictive amounts of space and limited lighting are some of the challenges presented by a server with a relatively small depth positioned in a server rack with a relatively large depth. Some server racks may define a depth of about 4 feet, while some servers or other components stored in the server rack may define a depth of about 1 foot. A tool configured to securely receive a plug, provide a light source, assist in coupling the plug to a receptacle, and then release the plug may increase efficiencies in server set up and maintenance.

SUMMARY

In accordance with an aspect of the disclosure, a tool includes a first member, a second member, and a third member. The first member includes a first end and a second end opposite the first end with respect to a first direction. The second member extends from the second end in the first direction, and the second member includes a first end of the second member and a second end of the second member opposite the first end of the second member with respect to the first direction. The third member extends from the second end of the second member in the first direction, and the third member includes a first end of the third member and a second end of the third member opposite the first end of the third member with respect to the first direction. The third member includes a third member body and a third member recess that extends into the third member body. The third member body defines a first opening of the third member recess that faces the first direction, a second opening of the third member recess that faces a second direction that is opposite the first direction, and a third opening of the third member recess that faces a third direction that is perpendicular to the first direction. The first opening defines a first width measured in a fourth direction that is perpendicular to both the first direction and the third direction, the second opening defines a second width measured in the fourth direction, and the first width is greater than the second width.

In accordance with an aspect of the disclosure, a tool includes a first member, a second member, and a third member. The first member includes a first end and a second end opposite the first end with respect to a first direction. The second member extends from the second end in the first direction, and the second member includes a first end of the second member and a second end of the second member opposite the first end of the second member with respect to the first direction. The second member is elongate along a central axis that is parallel to the first direction. The third member extends from the second end of the second member in the first direction, and the third member includes a first end of the third member and a second end of the third member opposite the first end of the third member with respect to the first direction. The third member includes a third member body and a third member recess that extends into the third member body. The third member body defines a first opening of the third member recess that faces the first direction, and a second opening of the third member recess that faces a second direction that is opposite the first direction. The central axis intersects the first opening, and the central axis is offset from the second opening with respect to a third direction that is perpendicular to the first direction.

In accordance with an aspect of the disclosure, a tool kit includes a first member, a second member, a third member, and a fourth member. The first member includes a first end and a second end opposite the first end with respect to a first direction. The second member is configured to be releasably coupled to the second end of the first member such that the second member extends from the first member in the first direction, and the second member includes a first end of the second member and a second end of the second member opposite the first end of the second member with respect to the first direction when the second member is coupled to the first member. The third member is configured to be releasably coupled to the second end of the second member. The third member includes a first end of the third member and a second end of the third member opposite the first end of the third member with respect to the first direction when the third member is coupled to the second member. The third member includes a third member body and a third member recess that extends into the third member body, and the third member body defines a shape of the third member recess within a plane parallel to the first direction. The fourth member is configured to be releasably coupled to the second end of the second member. The fourth member includes a first end of the fourth member and a second end of the fourth member opposite the first end of the fourth member with respect to the first direction when the fourth member is coupled to the second member, and the fourth member includes a fourth member body and a fourth member recess that extends into the fourth member body. The fourth member body defines a shape of the fourth member recess within a plane parallel to the first direction. The shape of the third member recess is different than the shape of the fourth member recess.

BRIEF DESCRIPTION OF THE DRAWINGS

The foregoing summary, as well as the following detailed description of illustrative embodiments of the application, will be better understood when read in conjunction with the appended drawings. For the purposes of illustrating the present disclosure, there is shown in the drawings illustrative embodiments. It should be understood, however, that the application is not limited to the specific embodiments and methods disclosed, and reference is made to the claims for that purpose. In the drawings:

DETAILED DESCRIPTION

Figure 1:
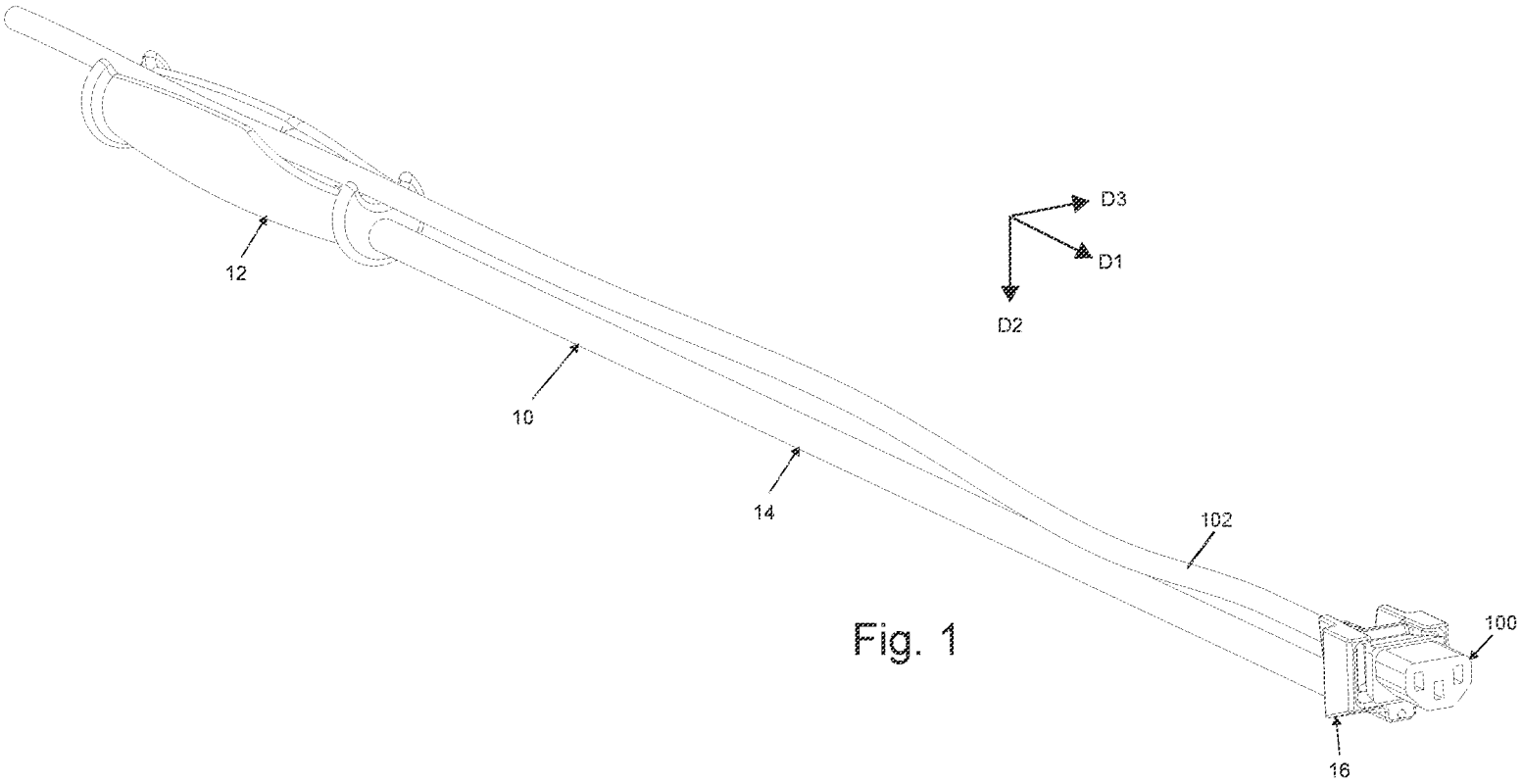
FIG. 1 is an isometric view of a tool according to one aspect of the disclosure, and a plug positioned within a recess of the tool.
Figure 2:
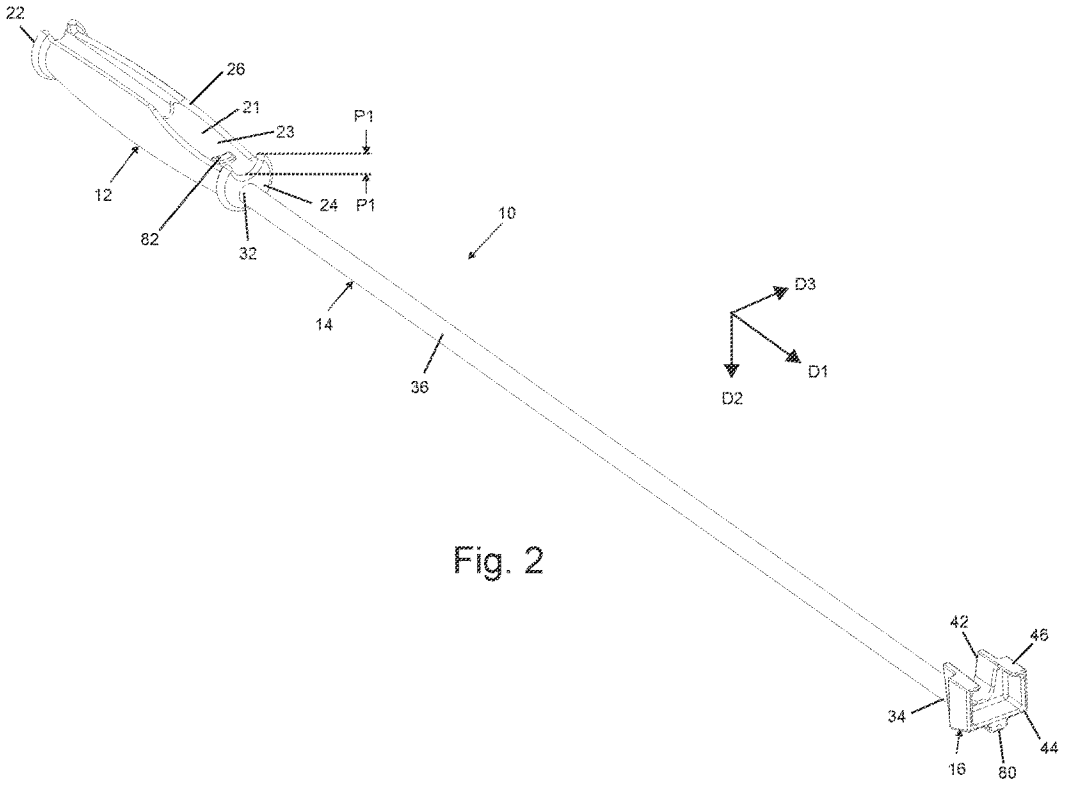
FIG. 2 is an isometric view of the tool illustrated in FIG. 1.
Figure 3:
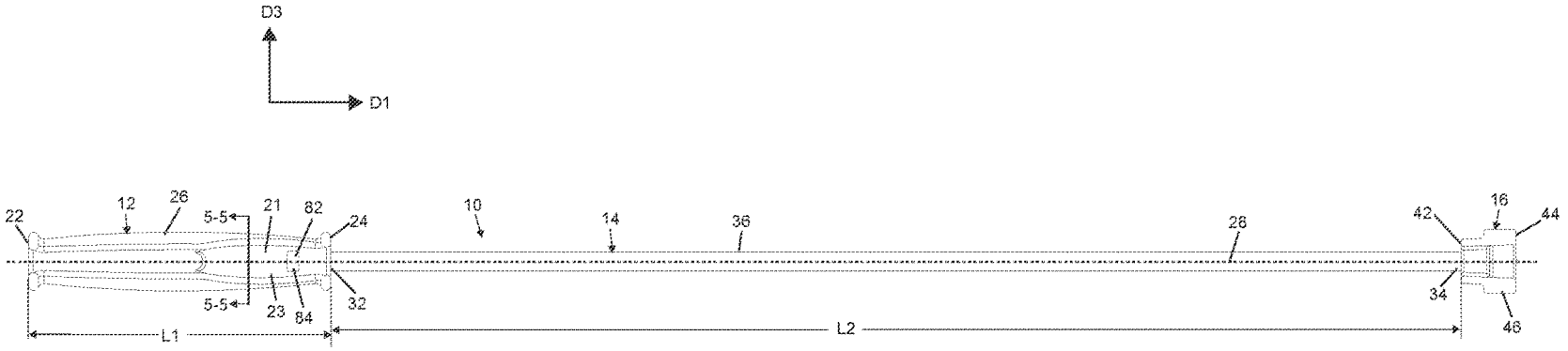
FIG. 3 is a top plan view of a tool illustrated in FIG. 1.
Figure 4:
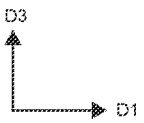
FIG. 4 is a side elevation view of the tool illustrated in FIG. 1.
Figure 5:
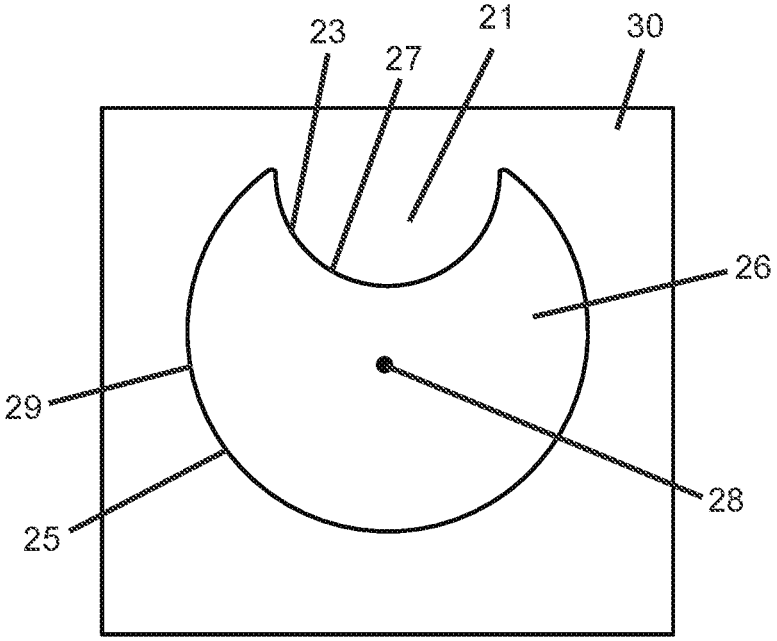
FIG. 5 is a cross-sectional view of a first member of the tool illustrated in FIG. 1 along line 5-5.

Certain terminology is used in the following description for convenience only and is not limiting. The words "lower" and "upper" designate directions in the drawings to which reference is made. Aspects of the disclosure will now be described in detail with reference to the drawings, wherein like reference numbers refer to like elements throughout, unless specified otherwise. Certain terminology is used in the following description for convenience only and is not limiting. The term "plurality", as used herein, means more than one. The terms "a portion" and "at least a portion" of a structure include the entirety of the structure. Certain features of the disclosure which are described herein in the context of separate embodiments may also be provided in combination in a single embodiment. Conversely, various features of the disclosure that are described in the context of a single embodiment may also be provided separately or in any subcombination.

Referring to FIG. 1, a tool 10 is configured to receive at least a portion of a plug 100, secure the plug 100 relative to the tool 10 during movement of the plug to a receptacle, and release the plug 100 once the plug 100 is inserted into the receptacle. According to one aspect of the disclosure, the tool 10 includes a first member 12, a second member 14 coupled to the first member 12, and a third member 16 coupled to the second member 14.

Referring to FIGS. 1 to 4, the first member 12 may include a handle configured to be gripped and held by a human hand. The first member 12 includes a first end 22, a second end 24, and a first member body 26 that extends between the first end 22 and the second end 24, for example from the first end 22 to the second end 24. The first member 12 may extend along an axis 28, for example a central axis, that extends through both the first end 22 and the second end 24. According to one aspect of the disclosure, the second end 24 is spaced from the first end 22 along a first direction D1. As shown in the illustrated embodiment, the first end 22 may be opposite the second end 24 with respect to the first direction D1. The first member 12 may be elongate along the axis 28, and the axis 28 may be parallel to the first direction D1.

The second member 14 may include a shaft. The second member 14 includes a first end 32, a second end 34, and a second member body 36 that extends between the first end 32 and the second end 34, for example from the first end 32 to the second end 34. The second member 14 may extend along an axis, for example the axis 28 when the second member 14 is coupled to the first member 12.

According to one aspect of the disclosure, the second member 14 is configured to be coupled to the first member 12 such that the second member 14 extends from the second end 24 of the first member 12 in the first direction D1. When the second member 14 is coupled to the first member 12 the second end 34 may be spaced from the first end 32 along the first direction D1. As shown in the illustrated embodiment, the first end 32 may be opposite the second end 34 with respect to the first direction D1. The second member 14 may be elongate along the central axis 28, and the central axis 28 may be parallel to the first direction D1.

The third member 16 may include a tip. The third member 16 includes a first end 42, a second end 44, and a third member body 46 that extends between the first end 42 and the second end 44, for example from the first end 42 to the second end 44. The third member 16 may extend along an axis, for example the axis 28 when the third member 16 is coupled to the second member 14.

According to one aspect of the disclosure, the third member 16 is configured to be coupled to the second member 14 such that the third member 16 extends from the second end 34 of the second member 14 in the first direction D1. When the third member 16 is coupled to the second member 14 and the second member 14 is coupled to the first member 12, the second end 44 may be spaced from the first end 42 along the first direction D1. As shown in the illustrated embodiment, the first end 42 may be opposite the second end 44 with respect to the first direction D1. The third member 16 may be elongate along the central axis 28, and the central axis 28 may be parallel to the first direction D1.

According to one aspect of the disclosure, the first member 12, the second member 14, the third member 16, or any combination thereof may be monolithic. For example, the first member 12, the second member 14, and the third member 16 may all be one continuous piece that are not separable without plastic deformation of the tool 10. According to another aspect of the disclosure, one or more of the first member 12, the second member 14, and the third member 16 may be formed as separate pieces and then coupled together. In one embodiment, the first member 12, the second member 14, the third member 16 formed as separate pieces may be coupled together permanently such that they are not separable without plastic deformation of the tool 10.

In another embodiment, the first member 12, the second member 14, the third member 16 formed as separate pieces may be releasably, or temporarily, coupled or coupleable such that the tool 10 defines an assembled configuration in which the first member 12, the second member 14, and the third member 16 are coupled together, for example such that each of the first member 12, the second member 14, and the third member 16 is aligned along the axis 28. The tool 10 may further define a disassembled configuration in which at least one of the first member 12, the second member 14, and the third member 16 is separate from the others of the first member 12, the second member 14, and the third member 16.

The first member 12 may include a first member recess 21 defined at least partially by the first member body 26. As shown in the illustrated embodiment, the first member recess 21 extends into the first member body 26 in a second direction D2 that is perpendicular to the first direction D1. The first member recess 21 defines a first depth P1 measured in the second direction D2. The first depth P1 of the first member recess 21 may be constant along the first direction D1, or may vary along the first direction D1 as shown in the illustrated embodiment. The first member recess 21 further extends between the first end 22 and the second end 24 in the first direction D1, such that the first member recess 21 defines a first length L1 measured in the first direction D1. As shown in the illustrated embodiment, the first member recess 21 may extend from the first end 22 to the second end 24.

Referring to FIGS. 1 to 5, according to one aspect of the disclosure, the first member body 26 includes a concave surface 23 that at least partially defines the first member recess 21. According to another aspect of the disclosure, the first member body 26 includes a surface that is substantially flat, which at least partially defines the first member recess 21. The first member body 26 defines a cross-sectional shape within a plane 30 that the axis 28 is normal to. As shown in the illustrated embodiment, the cross-sectional shape of the first member body 26 includes a convex portion 25, for example the concave surface 23, and a concave portion 27, for example a concave surface 29.

Referring to FIGS. 1 to 4, the second member 14 is configured to be coupled to the first member 12 such that the second member 14 extends from the second end 24 of the first member 12. The tool 10 defines an assembled configuration in which the first member 12 is secured to the second member 14 such that the first member 12 and the second member 14 are rotationally and translationally secured relative to one another. According to one aspect of the disclosure, in the assembled configuration the first member 12 and the second member 14 are permanently secured to one another such that the first member 12 and the second member 14 cannot be separated without plastically deforming the tool 10. According to another aspect of the disclosure, in the assembled configuration the first member 12 and the second member 14 are releasably secured to one another such that the first member 12 and the second member 14 can be separated without plastically deforming the tool 10.

The second member body 36 defines a second length L2 measured from the first end 32 to the second end 34 along a direction. When the second member body 36 is coupled to the first member body 26, the second length L2 may be measured along the first direction D1. According to one aspect of the disclosure, the second length L2 may be between about 1 foot and about 3 feet. According to one aspect of the disclosure, the second length L2 may be between about 1.5 feet and about 2.5 feet.

Figure 6:
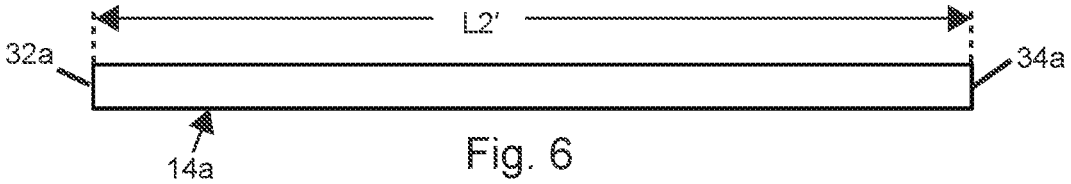
FIG. 6 is a side elevation view of a second member of the tool illustrated in FIG. 1, according to one aspect of the disclosure.
Figure 7:
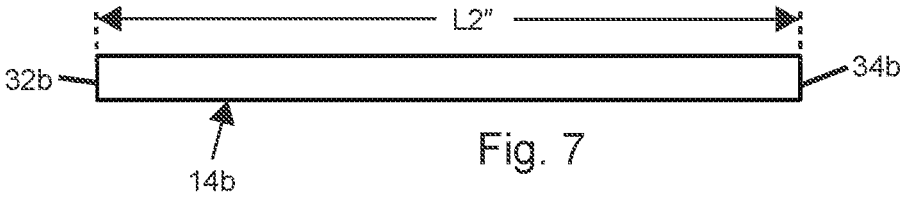
FIG. 7 is a side elevation view of a second member of the tool illustrated in FIG. 1, according to another aspect of the disclosure.
Figure 8:
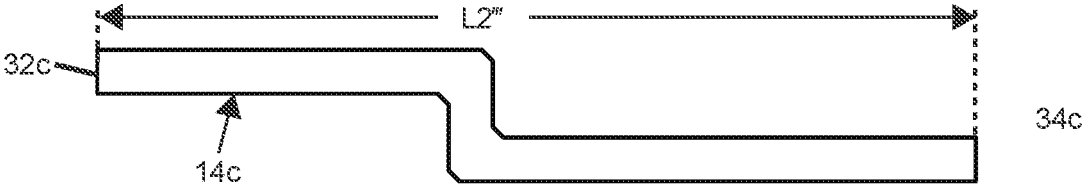
FIG. 8 is a side elevation view of a second member of the tool illustrated in FIG. 1, according to another aspect of the disclosure.

Referring to FIGS. 6 to 8, the second member body 36 may be substantially straight, as shown in FIGS. 6 and 7. According to one aspect of the disclosure, the second member body 36 may be curved. According to one aspect of the disclosure, the second member body 36 may include at least one bend 38 such that the second member body 36 is not substantially straight from the first end 32 to the second end 34, as shown in FIG. 8. According to one aspect of the disclosure the tool 10 may include a plurality of second members 14. The plurality of second members 14 may include second members 14 with different lengths, different shapes, or both. The plurality of second members 14 may include a first second member 14*a*, a second second member 14*b*, a third second member 14*c*, or any combination thereof. The second member body 36 may be solid, grooved, or hollow. A grooved or hollow second member body 36 may allow for the passage of wires, for example electrical wires, from the first member 12 to the third member 16.

According to one aspect of the disclosure, the first second member 14*a* is substantially straight from the first end 32*a* to the second end 34*a*. The first second member 14*a* may define a first second length L2' measured from the first end 32*a* to the second end 34*a*. The second second member 14*b* may define a second second length L2" measured from the first end 32*b* to the second end 34*b*, and the second second length L2" is different than the first second length L2'. The third second member 14*c* includes at least one bend 38, for example two ninety-degree bends 38 such that the third second member 14*c* is not substantially straight from the first end 32*c* to the second end 34*c*. The third second member 14*c* may define a third second length L2''' measured from the first end 32*c* to the second end 34*c*. The third second length L2''' may be the same as either the first second length L2' or the second second length L2". Alternatively, the third second length L2''' may be different than both the first second length L2' and the second second length L2".

Figure 9:
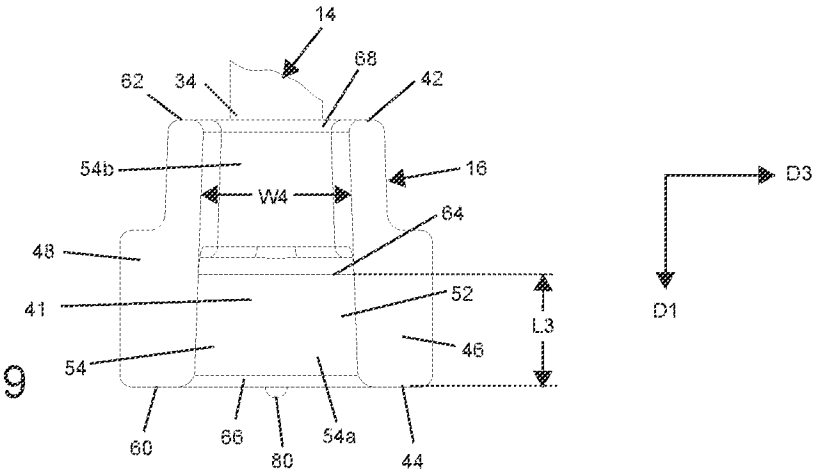
FIG. 9 is a top plan view of a third member of the tool illustrated in FIG. 1, according to one aspect of the disclosure.
Figure 10:
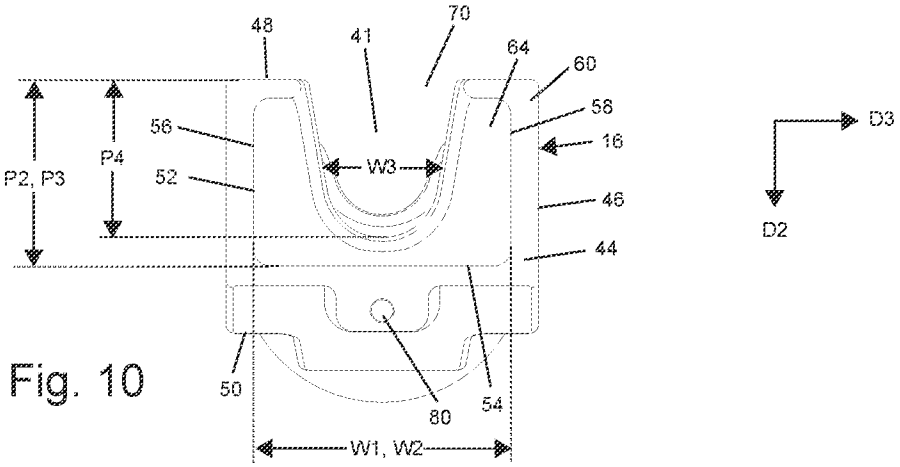
FIG. 10 is a front elevation view of the third member illustrated in FIG. 9.
Figure 11:
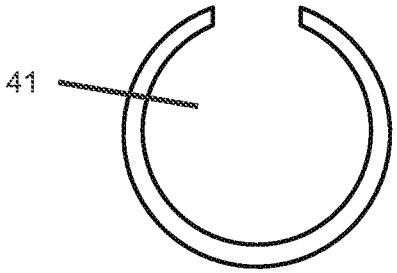
FIG. 11 is a front elevation view of the third member of the tool illustrated in FIG. 1, according to another aspect of the disclosure.
Figure 12:
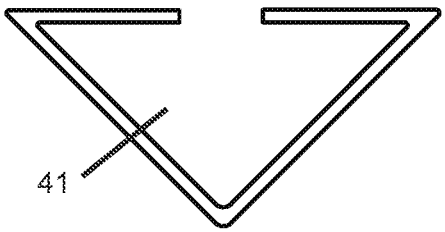
FIG. 12 is a front elevation view of the third member of the tool illustrated in FIG. 1, according to another aspect of the disclosure.
Figure 13:
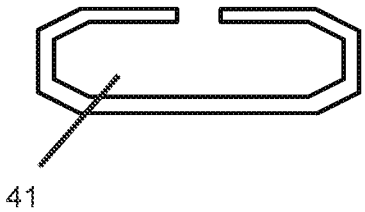
FIG. 13 is a front elevation view of the third member of the tool illustrated in FIG. 1, according to another aspect of the disclosure.
Figure 14:
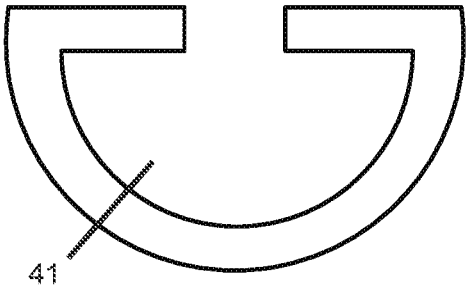
FIG. 14 is a front elevation view of the third member of the tool illustrated in FIG. 1, according to another aspect of the disclosure.
Figure 15:
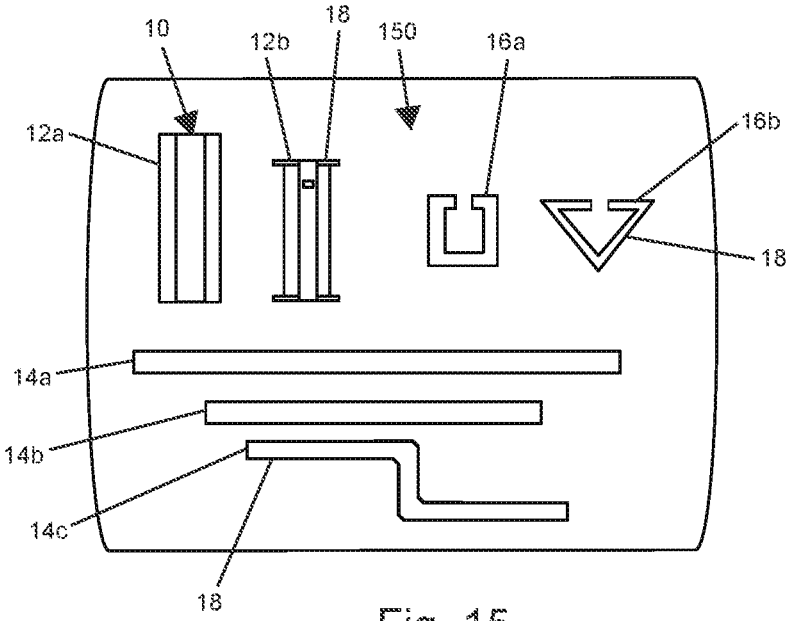
FIG. 15 is a top plan view of a tool kit according to one aspect of the disclosure.

Referring to FIGS. 9 and 10, the third member 16 is configured to be coupled to the second member 14 such that the third member 16 extends from the second end 34 of the second member 14. The tool 10 defines an assembled configuration in which the third member 16 is secured to the second member 14 such that the third member 16 and the second member 14 are rotationally and translationally secured relative to one another. According to one aspect of the disclosure, in the assembled configuration the third member 16 and the second member 14 are permanently secured to one another such that the third member 16 and the second member 14 cannot be separated without plastically deforming the tool 10. According to another aspect of the disclosure, in the assembled configuration the third member 16 and the second member 14 are releasably secured to one another such that the third member 16 and the second member 14 can be separated without plastically deforming the tool 10.

The third member 16 may include a third member recess 41 defined at least partially by the third member body 46. As shown in the illustrated embodiment, the third member recess 41 extends into the third member body 46 in the second direction D2 when the third member 16 is coupled to the second member 14 and the second member 14 is coupled to the first member 12. The third member body 46 may include an upper surface 48 and a lower surface 50, the lower surface 50 spaced from the upper surface 48 in the second direction D2. The third member body 46 further includes an inner surface 52 that at least partially defines the third member recess 41. The inner surface 52 may include a base surface 54 that is spaced from the upper surface 48 in the second direction D2, a first side wall 56, and a second side wall 58. The first side wall 56 is spaced from the second side wall 58 in a third direction D3 that is perpendicular to both the first direction D1 and the second direction D2, when the third member 16 is coupled to the second member 14 and the second member 14 is coupled to the first member 12.

The third member recess 41 defines a second depth P2 measured in the second direction D2. As shown in the illustrated embodiment the second depth P2 is measured from the upper surface 48 to the base surface 54 in the second direction D2. According to one aspect of the disclosure the second depth P2 may be between about 0.5 in. and about 2 in. The third member recess 41 defines a first width W1 measured in the third direction D3 from the first side wall 56 to the second side wall 58. According to one aspect of the disclosure the first width W1 may be between about 0.5 in. and about 2.5 in. The second depth P2 may be greater than, less than, or equal to the width W.

The third member body 46 may further include a front surface 60 that faces in the first direction D1 and a rear surface 62. The front surface 60 is spaced from the rear surface 62 in the first direction D1 when the third member 16 is coupled to the second member 14 and the second member 14 is coupled to the first member 12. The inner surface 52 may further include a stop surface 64 that both faces in the first direction D1, and is spaced from the front surface 60 in the direction opposite the first direction D1, when the third member 16 is coupled to the second member 14 and the second member 14 is coupled to the first member 12.

The third member recess 41 further extends between the first end 42 and the second end 44 in the first direction D1 when the third member 16 is coupled to the second member 14 and the second member 14 is coupled to the first member 12, such that the third member recess 41 defines a third length L3 measured in the first direction D1. As shown in the illustrated embodiment, the third length L3 is measured from the stop surface 64 to the front surface 60 in the first direction D1. According to one aspect of the disclosure the third length L3 is between about 0.5 in. and about 2 in.

The third member recess 41 is sized and configured to at least partially receive at least one of a Type A plug, a Type B plug, a Type C plug, a Type D plug, a Type E plug, a Type F plug, a Type G plug, a Type H plug, a Type I plug, a Type J plug, a Type K plug, a Type L plug, a Type M plug, a Type N plug, a Type 0 plug. According to one aspect of the disclosure the third member 16 is configured such that the second depth P2 and the third length L3 are each sized to at least partially receive one or more of a Type A plug, a Type B plug, a Type C plug, a Type D plug, a Type E plug, a Type F plug, a Type G plug, a Type H plug, a Type I plug, a Type J plug, a Type K plug, a Type L plug, a Type M plug, a Type N plug, a Type 0 plug.

According to one aspect of the disclosure, the third member recess 41 includes a first portion 43 and a second portion 45. The first portion 43 extends into the third member body 46 from the front surface 60 in the direction opposite the first direction D1 and terminates at the stop surface 64. The second portion 45 extends into the third member body 46 in the direction opposite the first direction D2 and extends through the rear surface 62. The third member body 46 may define a first opening 66 of the third member recess 41, a second opening 68 of the third member recess 41, a third opening 70 of the third member recess 41, or any combination thereof.

As shown in the illustrated embodiment, the first opening 66 faces the first direction and is at least partially defined by the front surface 60, the second opening 68 faces the direction opposite the first direction D1 and is at least partially defined by the rear surface 62, and the third opening 70 faces the direction opposite the third direction D3 and is at least partially defined by the upper surface 48. According to one aspect of the disclosure the first opening 66 defines a second width W2 measured in the third direction D3, the second opening 68 defines a third width W3 measured in the third direction D3, and the second width W2 is greater than the third width W3. The third opening 70 may define a fourth width W4 that is less than the second width W2. The fourth width W4 may be less than, greater than, or equal to the third width W3.

According to one aspect of the disclosure the first opening 66 defines a third depth P3 measured in the third direction D3 from the upper surface 48 to a first portion of the base surface 54*a* in the first portion 43, the second opening 68 defines a fourth depth P4 measured in the third direction D3 from the upper surface 48 to a second portion of the base surface 54*b* in the second portion 45. As shown in the illustrated embodiment, the third depth P3 may be greater than the fourth depth P4.

The third member body 46 may define a shape of the third member recess 41 within a plane that the axis 28 is normal to. The shape of the third member recess 41 may correspond to at least one of a Type A plug, a Type B plug, a Type C plug, a Type D plug, a Type E plug, a Type F plug, a Type G plug, a Type H plug, a Type I plug, a Type J plug, a Type K plug, a Type L plug, a Type M plug, a Type N plug, a Type O plug. According to one aspect of the disclosure the shape of the third member recess 41 corresponds to a shape of the respective plug configured to be inserted into the third member recess 41 such that rotation of the respective plug within the third member recess 41 about the axis 28 is restricted.

Referring to FIGS. 9 to 14 the shape of the third member recess 41, defined for example in a plane that that the axis 28 is normal to, may be rectangular, square, triangular, circular, or some other polygonal shape. Alternatively, the shape of the third member recess 41 may be an irregular, or non-polygonal, shape.

Referring to FIGS. 1 to 10, the tool 10 may include a light source 80. According to one aspect of the disclosure the tool 10 is configured such that the light source 80 emits light in the first direction D1. The tool 10 supports the light source 80, for example a light-emitting diode, such that the light source 80 faces in the first direction D1. As shown in the illustrated embodiment, the light source 80 is carried by the third member 16. The tool 10 may further include a power source, for example a battery, which is configured to provide power to the light source 80. The power source may be carried by, for example enclosed within, the first member body 26.

The tool 10 may further include a switch 82 electrically coupled to both the power source and the light source 80. The tool 10 supports the switch 82 such that when the switch is in a first position the power source is electrically coupled to the light source 80 and the light source 80 emits light, and when the switch 82 is in a second position the power source is electrically decoupled from the light source 80 and the light source 80 does not emit light. According to one aspect of the disclosure, the switch 82 may be carried by the first member 12, for example the switch 82 may be positioned within the first member recess 21. As shown in the illustrated embodiment, the switch 82 is positioned on the concave surface 23 and within the first member recess 21. The switch 82 may include a button 84 and the concave surface 23 may include a hole sized to receive the button 84 such that the button 84 is movable toward the axis 28, for example along the second direction D2, from the first position to the second position.

According to one aspect of the disclosure, in the assembled configuration the first member 12, the second member 14, the third member 16, or any combination thereof may be elongate along the axis 28. The axis 28 may be a central axis of the second member 14. The axis 28, for example the central axis of the second member 14, may intersect the third member recess 41 in the assembled configuration. The axis of the second member 14 may both intersect the first opening 66 of the third member recess 41 and be offset from the second opening 68 of the third member recess 41 with respect to the second direction D2.

A method of use of the tool 10 includes the step of inserting the plug 100 at least partially into the third member recess 41. The inserting step may include the step of passing a cord 102 of the plug 100 through the second opening 68 of the third member recess 41. The method may further include the step of positioning the cord 102 at least partially within the first member recess 21. The positioning step may include the step of activating the light source 80. The activating step may include the step of abutting the switch 82 with the cord 102 thereby moving the switch 82 from the first position to the second position. The method may further include the step of aligning the tool 10 with a receptacle configured to receive the plug 100 and electrically coupling the plug 100 with the receptacle. The method may further include the step of removing the plug 100 from the third member recess 41. The removing step may include the step of removing the cord 102 from the first member recess 21. The step of removing the cord 102 from the first member recess 21 may include the step of moving the switch 82 from the second position to the first position and thereby turning off the light source 80.

Referring to FIGS. 1 to 15, the tool 10 may be provided as part of a tool kit 150. According to one aspect of the disclosure the tool kit 150 includes the first member 12, the second member 14, the third member 16, and a fourth member 18. The tool kit 150 may include a plurality of first members 12, a plurality of second members 14, a plurality of third members 16, or any combination thereof. According to one aspect of the disclosure, the plurality of second members 14 include second members 14 with different lengths, different shapes, or both. As shown in the illustrated embodiment, the tool kit 150 may include the first second member 14*a*, the second second member 14*b*, the third second member 14*c*, or any combination thereof. The fourth member 18 may be one of the plurality of second members 14.

According to one aspect of the disclosure, the plurality of first members 12 include first members 12 with different lengths, different shapes, or both. As shown in the illustrated embodiment, the tool kit 150 may include a first first member 12*a*, a second first member 12*b*, or any combination thereof. The fourth member 18 may be one of the plurality of first members 12.

According to one aspect of the disclosure, the plurality of third members 16 include third members 16 with different lengths, different shapes, or both. As shown in the illustrated embodiment, the tool kit 150 may include at least a first third member 16*a*, a second third member 16*b*, or both. The shape of the first third member 16*a* may be different than the shape of the second third member 16*b*, such that the first third member 16*a* is configured to receive one type of plug and the second third member 16*b* is configured to receive another type of plug. The fourth member 18 may be one of the plurality of third members 16.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range including the stated ends of the range, unless otherwise indicated herein, and each separate value is incorporated into the specification as if it were individually recited herein. All methods described herein can be performed in any suitable order unless otherwise indicated herein or otherwise clearly contradicted by context.

Although the disclosure has been described in detail, it should be understood that various changes, substitutions, and alterations can be made herein without departing from the spirit and scope of the invention as defined by the appended claims. Moreover, the scope of the present disclosure is not intended to be limited to the particular embodiments described in the specification. As one of ordinary skill in the art will readily appreciate from the disclosure of the present invention, processes, machines, manufacture, composition of matter, means, methods, or steps, presently existing or later to be developed that perform substantially the same function or achieve substantially the same result as the corresponding embodiments described herein may be utilized according to the present disclosure.

I claim:

1. A tool comprising:

a first member including a first end and a second end opposite the first end with respect to a first direction;

a second member that extends from the second end in the first direction, the second member including a first end of the second member and a second end of the second member opposite the first end of the second member with respect to the first direction; and a third member that extends from the second end of the second member in the first direction, the third member including a first end of the third member and a second end of the third member opposite the first end of the third member with respect to the first direction, the third member including a third member body and a third member recess that extends into the third member body, the third member body defining: 1) a first opening of the third member recess that faces the first direction, 2) a second opening of the third member recess that faces a second direction that is opposite the first direction, and 3) a third opening of the third member recess that faces a third direction that is perpendicular to the first direction;

wherein the first opening defines a first width measured in a fourth direction that is perpendicular to both the first direction and the third direction, the second opening defines a second width measured in the fourth direction, and the first width is greater than the second width.

2. The tool of claim 1, wherein the first opening defines a first depth measured in the third direction, the second opening defines a second depth measured in the third direction, and the first depth is greater than the second depth.

3. The tool of claim 1, further comprising a light source.

4. The tool of claim 3, wherein the light source is supported by the third member such that the light source is configured to emit light in the first direction.

5. The tool of claim 4, further comprising a battery and a switch, the switch electrically coupled to both the battery and the light source such that: 1) when the switch is in a first position the battery is electrically coupled to the light source and the light source emits light, and 2) when the switch is in a second position the battery is electrically decoupled from the light source and the light source does not emit light.

6. The tool of claim 5, wherein the first member includes a first member body that extends between the first end of the first member and the second end of the first member, the first member body defines a first member recess that extends into the first member body in the third direction, and the switch is positioned within the first member recess.

7. The tool of claim 6, wherein the first member body includes a concave surface that at least partially defines the first member recess, and the switch is positioned on the concave surface.

8. The tool of claim 1, wherein the first member includes a first member body that extends between the first end of the first member and the second end of the first member, the first member body defines a first member recess that: 1) extends into the first member body in the third direction; and 2) extends through the first member body from the first end of the first member to the second end of the first member in the first direction.

9. The tool of claim 1, the first member, the second member, the third member, or any combination thereof is monolithic.

10. The tool of claim 1, wherein the second member and the third member are releasably coupled such that the second member and the third member are configured to be repeatedly coupled and decoupled.

11. The tool of claim 1, wherein the second member is extends along a central axis that is parallel to the first direction, and the central axis intersects the third member recess.

12. The tool of claim 11, wherein the central axis: 1) intersects the first opening, and 2) is offset from the second opening with respect to the third direction.

13. A tool comprising:

a first member including a first end and a second end opposite the first end with respect to a first direction;

a second member that extends from the second end in the first direction, the second member including a first end of the second member and a second end of the second member opposite the first end of the second member with respect to the first direction, the second member elongate along a central axis that is parallel to the first direction; and a third member that extends from the second end of the second member in the first direction, the third member including a first end of the third member and a second end of the third member opposite the first end of the third member with respect to the first direction, the third member including a third member body and a third member recess that extends into the third member body, the third member body defining: 1) a first opening of the third member recess that faces the first direction, and 2) a second opening of the third member recess that faces a second direction that is opposite the first direction, wherein the central axis intersects the first opening, and the central axis is offset from the second opening with respect to a third direction that is perpendicular to the first direction.

14. The tool of claim 13, further comprising a light source supported by the third member such that the light source is configured to emit light in the first direction.

15. The tool of claim 14, further comprising a battery and a switch, the switch electrically coupled to both the battery and the light source such that: 1) when the switch is in a first position the battery is electrically coupled to the light source and the light source emits light, and 2) when the switch is in a second position the battery is electrically decoupled from the light source and the light source does not emit light.

16. The tool of claim 15, wherein the first member includes a first member body that extends between the first end of the first member and the second end of the first member, the first member body defines a first member recess that extends into the first member body in the third direction, and the switch is positioned within the first member recess.

17. The tool of claim 16, wherein the first member body includes a concave surface that at least partially defines the first member recess, and the switch is positioned on the concave surface.

18. A tool kit comprising:

a first member including a first end and a second end opposite the first end with respect to a first direction;

a second member configured to be releasably coupled to the second end of the first member such that the second member extends from the first member in the first direction, the second member including a first end of the second member and a second end of the second member opposite the first end of the second member with respect to the first direction when the second member is coupled to the first member;

a third member configured to be releasably coupled to the second end of the second member, the third member including a first end of the third member and a second end of the third member opposite the first end of the third member with respect to the first direction when the third member is coupled to the second member, the third member including a third member body and a third member recess that extends into the third member body, the third member body defining a shape of the third member recess within a plane parallel to the first direction; and a fourth member configured to be releasably coupled to the second end of the second member, the fourth member including a first end of the fourth member and a second end of the fourth member opposite the first end of the fourth member with respect to the first direction when the fourth member is coupled to the second member, the fourth member including a fourth member body and a fourth member recess that extends into the fourth member body, the fourth member body defining a shape of the fourth member recess within a plane parallel to the first direction, wherein the shape of the third member recess is different than the shape of the fourth member recess.

19. The tool kit of claim 18, further comprising a light source, a battery, and a switch, the switch electrically coupled to both the battery and the light source such that: 1) when the switch is in a first position the battery is electrically coupled to the light source and the light source emits light, and 2) when the switch is in a second position the battery is electrically decoupled from the light source and the light source does not emit light.

20. The tool kit of claim 19, wherein the first member includes a first member body that extends between the first end of the first member and the second end of the first member, the first member body includes a concave surface that defines a first member recess that extends into the first member body in a second direction that is perpendicular to the first direction, and the switch is positioned within the first member recess and on the concave surface.

* * * * *